US008075370B1

(12) United States Patent
Hancock

(10) Patent No.: US 8,075,370 B1
(45) Date of Patent: Dec. 13, 2011

(54) METHOD OF USING A BUTTOCKS UPLIFT AND SUPPORT DEVICE

(76) Inventor: Sherry H. Hancock, Laveen, AZ (US)

( * ) Notice: Subject to any disclaimer, the term of this patent is extended or adjusted under 35 U.S.C. 154(b) by 443 days.

(21) Appl. No.: 12/407,474

(22) Filed: Mar. 19, 2009

(51) Int. Cl.
*A41B 9/02* (2006.01)
*A41B 9/04* (2006.01)

(52) U.S. Cl. ..... 450/94; 450/81; 2/406; 2/400

(58) Field of Classification Search ..... 450/94, 450/95, 107–124, 153, 155, 156, 99, 81, 450/1; 2/69, 400, 403, 406, 408; 602/41, 602/52, 57–59, 903; 623/7; 606/204.35, 606/213–216; 424/400, 449
See application file for complete search history.

(56) References Cited

U.S. PATENT DOCUMENTS

| | | | | |
|---|---|---|---|---|
| 5,888,118 | A | 3/1999 | Kishi | |
| 5,902,170 | A | 5/1999 | Ganz | |
| 6,666,747 | B1 * | 12/2003 | Buntz | 450/81 |
| 7,257,847 | B2 | 8/2007 | Hart | |

* cited by examiner

*Primary Examiner* — Gloria Hale
(74) *Attorney, Agent, or Firm* — Crossley Patent Law; Mark A. Crossley

(57) ABSTRACT

A method of using a buttocks uplift and support device, the device having at least one layer, each layer stacked atop another layer and having an adhesive backing, the adhesive backing of an outermost layer removably covered by a coated second backing. The device is removably adhered to a wearer's buttocks and when in proper wearing position the inside edge of the outermost layer adheres to a wearer's inner thigh below a buttock, the upper edge to a wearer's buttocks, the outer edge to a wearer's outer thigh, the lower edge across and behind an upper portion of wearer's leg. When the device is in proper position the device uplifts, supports, and separates the wearer's buttocks. A wearer selectively removes a desired number of layers by pulling on a pulltab.

4 Claims, 3 Drawing Sheets

METHOD OF USING A BUTTOCKS UPLIFT AND SUPPORT DEVICE

BACKGROUND OF THE INVENTION

Various body shaping garments, including garments which support the buttocks, are known in the prior art. Prior art patents teach a buttocks lift and support device which includes a thigh support element having a buttock section and a midriff or abdominal section. Another patent provides a body-shaping undergarment which includes buttock support panels to support the shape of a wearer's buttocks. Still another patent provides a garment having an inner lining for adjusting the shape of the buttock and abdomen. However, what is needed is a method of using a buttocks uplift and support device which utilizes a buttocks uplift and support device having at least one flexible layer, each layer stacked atop another layer and having an adhesive backing which is removably pressed against the inner thigh, beneath the buttocks, and the outer thigh.

FIELD OF THE INVENTION

The present invention relates to body shaping garments, and more particularly, to a method of using a buttocks uplift and support device.

SUMMARY OF THE INVENTION

In view of the aforestated known types of buttocks uplift and support devices now present in the prior art, the general purpose of the present method of using a buttocks uplift and support device, described subsequently in greater detail, is to provide a method of using a buttocks uplift and support device which has many novel features that result in a method of using a buttocks uplift and support device which is not anticipated, rendered obvious, suggested, or even implied by prior art, either alone or in combination thereof.

To accomplish this, the present method of using a buttocks uplift and support device provides the present method of using a buttocks uplift and support device is illustrated. The method of using a buttocks uplift and support device utilizes a buttocks uplift and support device having at least one flexible layer. Each layer is stacked atop another layer. Each layer has a front side, a rear side, a lower edge, an outer edge, an upper edge parallel to the lower edge, a substantially convex inner edge, an inside edge. Each layer further has a substantially parallelepiped first portion comprising about one-third of the layer disposed between the lower edge, the inside edge, and a bottom portion of the inner edge, and a second portion comprising about two-thirds of the layer conjoined to the first portion and disposed between the lower edge, the outer edge, the upper edge and a top portion of the inner edge, the top portion and bottom portion of the inner edge curving inwardly toward a top corner of the lower edge.

In addition, an adhesive backing covers the entire rear side of each layer. A peel-off pulltab is removably disposed over the adhesive backing between the lower edge, the inside edge, and an amount of the bottom portion of the inner edge of each layer. A coated first backing removably covers each pulltab. A coated second backing removably covers the adhesive material disposed on the rear side of an outermost of the layers.

Utilizing a buttocks uplift and support device, a wearer removes the coated second backing disposed on the rear side of the outermost of the layers. Then, the wearer removably adheres the inside edge of the outermost of the layers in a wearing position to each of a wearer's buttocks. To place at least one layer in the wearing position, a wearer adheres the inside edge of the top sheet to a wearer's inner thigh below a buttock, the upper edge to a wearer's buttocks, the outer edge to a wearer's outer thigh, the lower edge across and behind an upper portion of wearer's leg. When the device is in proper position the device uplifts, supports, and separates the wearer's buttocks.

A wearer may select the number of layers desired for wearing in the wearing position by selectively removing at least one of the layers by pulling one of the pulltabs and removing the pulltab for each layer remaining in the wearing position. Each layer preferably has a width of about 11 inches, a maximum height of about 7¾ inches measured from the lower edge to the upper edge, and a minimum height of about 2½ inches measured from the lower edge to the bottom portion of the inner edge. These dimensions permit the device to conform to a wearer's buttocks, while uplifting and separating the buttocks. The adhesive layer is preferably formed of non-toxic material.

The present method enhances the appearance of a wearer's derriere and thereby allows a female wearer to feel sexy and young while providing her added confidence. The present method provides an inexpensive and more comfortable alternative solution to the problem of sagging buttocks as compared to uncomfortable and unsightly girdles, control slips and bodysuits, and other expensive slimming-type foundation garments. The present method allows the buttocks uplift and support device to be easily applied without the necessity of contorting a wearer's body to don as is often a problem with other slimming-type undergarments. The device used in the present method is also disposable.

Thus has been broadly outlined the more important features of the present method of using a buttocks uplift and support device so that the detailed description thereof that follows may be better understood and in order that the present contribution to the art may be better appreciated.

Numerous objects, features and advantages of the present method of using a buttocks uplift and support device will be readily apparent to those of ordinary skill in the art upon reading the following detailed description of presently preferred, but nonetheless illustrative, examples of the present method of using a buttocks uplift and support device when taken in conjunction with the accompanying drawings. In this respect, before explaining the current examples of the present method of using a buttocks uplift and support device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the method of using a buttocks uplift and support device. It is therefore important that the claims be regarded as including such equivalent constructions insofar as they do not depart from the spirit and scope of the present invention.

Objects of the present method of using a buttocks uplift and support device, along with various novel features that characterize the invention are particularly pointed out in the claims forming a part of this disclosure. For better understanding of the method of using a buttocks uplift and support device, its operating advantages and specific objects attained by its uses, refer to the accompanying drawings and description.

BRIEF DESCRIPTION OF THE DRAWINGS

Figures

FIG. 1 is a top isometric view of.

DETAILED DESCRIPTION OF THE DRAWINGS

Figure 1:
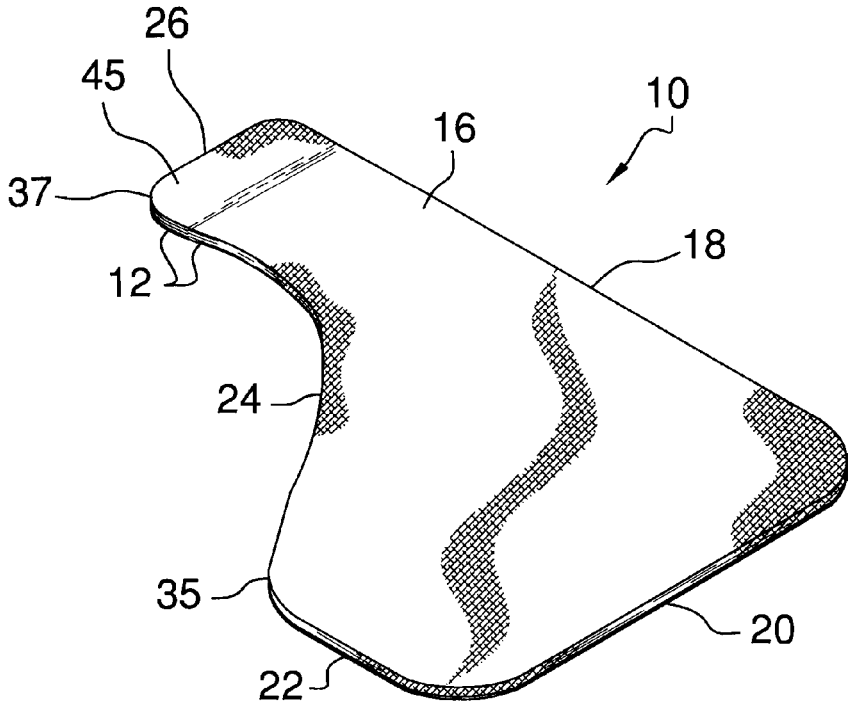
Figure 2:
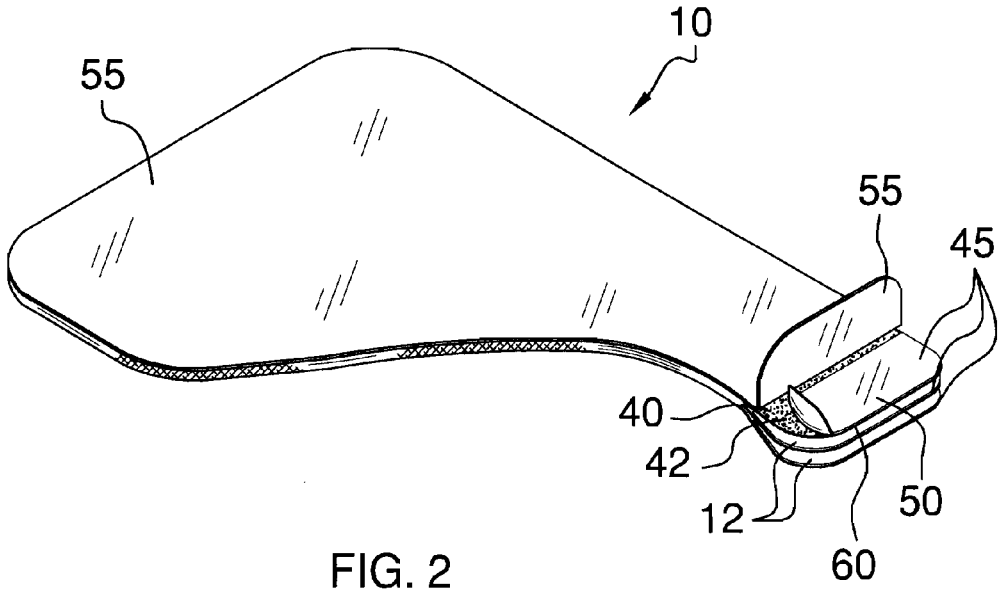
FIG. 2 is a left side elevation view.
Figure 3:
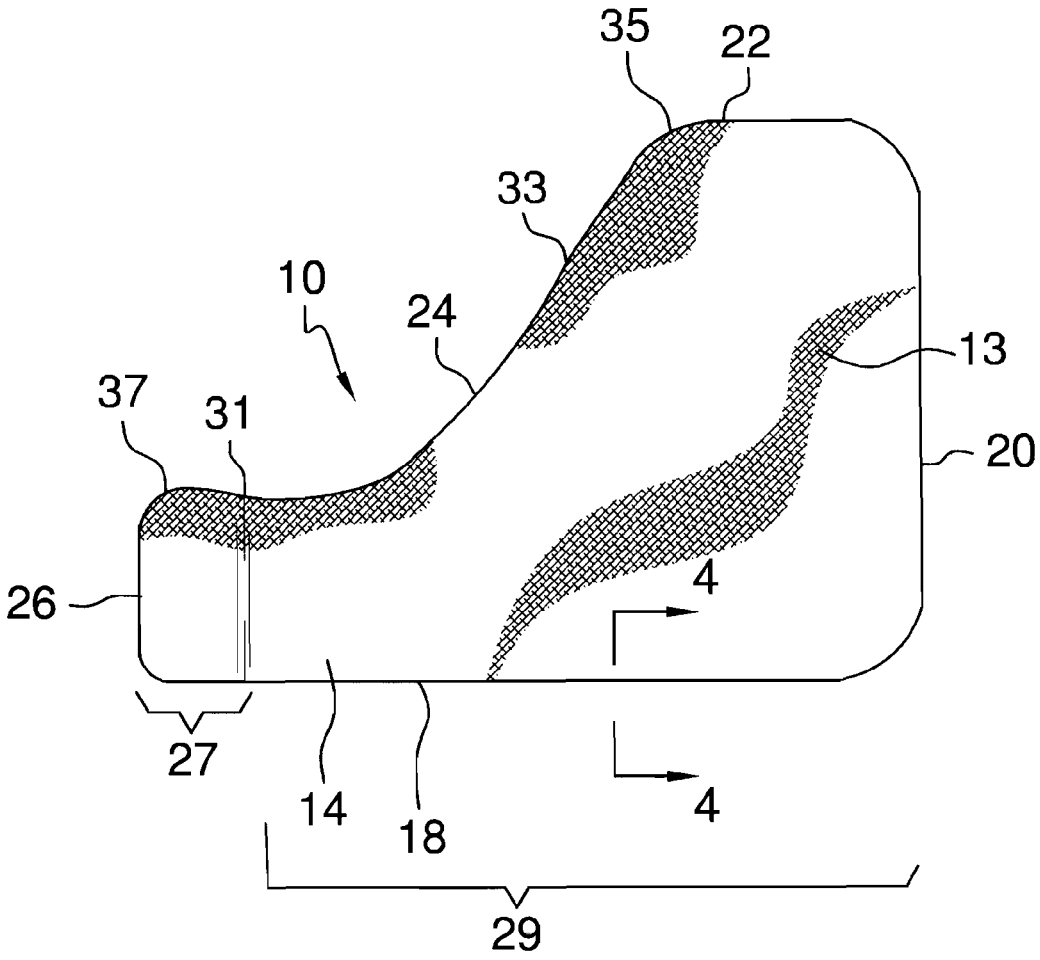
FIG. 3 is a right side elevation view.
Figure 4:
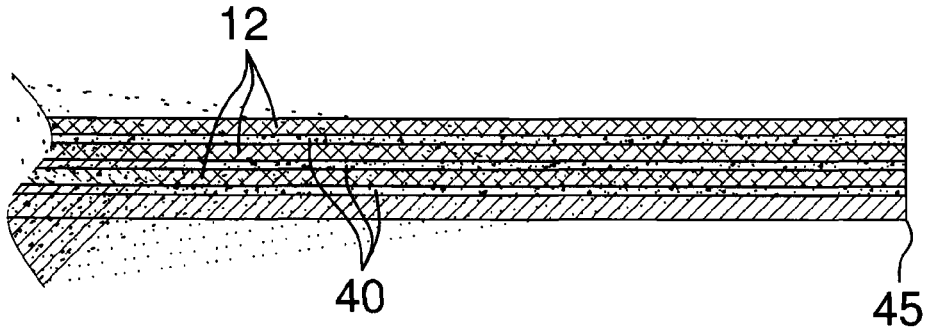
FIG. 4 is a cross-sectional view taken along line 4-4 of FIG. 3.
Figure 5:
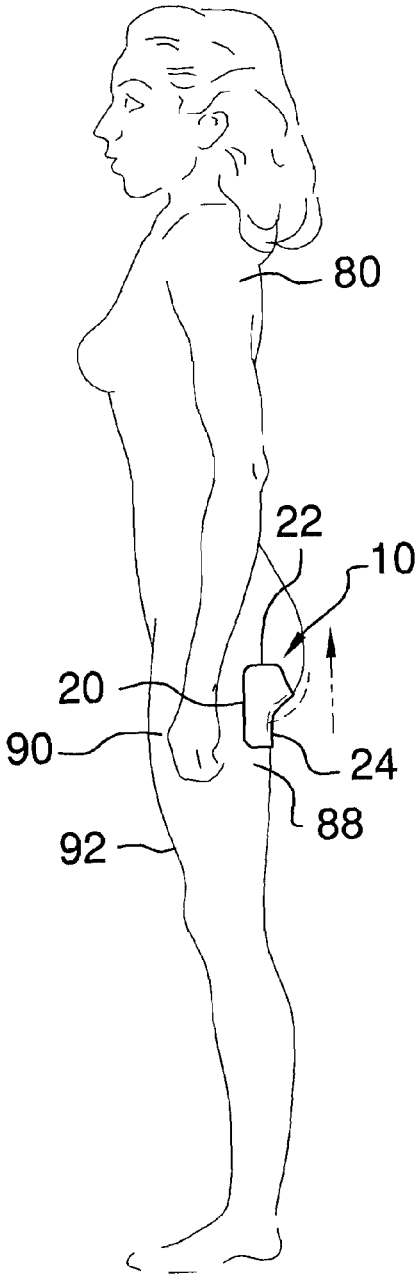
FIG. 5 is an in-use left side elevation view.
Figure 6:
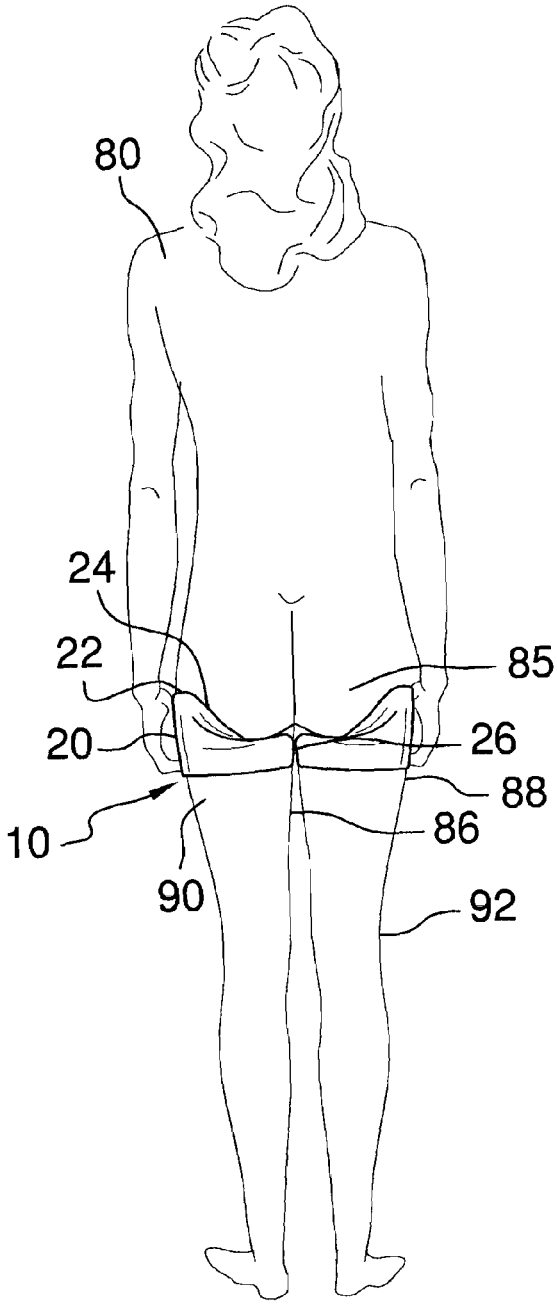
FIG. 6 is an in-use rear elevation view.

With reference now to the drawings, and in particular FIGS. 1 through 6 thereof, example of the instant method of using a buttocks uplift and support device employing the principles and concepts of the present method of using a buttocks uplift and support device will be described.

Referring to FIGS. 1 through 6, the present method of using a buttocks uplift and support device is illustrated. The method of using a buttocks uplift and support device utilizes a buttocks uplift and support device 10 having at least one flexible layer 12. Each layer 12 is stacked atop another layer 12. Each layer 12 has a front side 14, a rear side 16, a lower edge 18, an outer edge 20, an upper edge 22 parallel to the lower edge 18, a substantially convex inner edge 24, an inside edge 26. Each layer 12 further has a substantially parallelepiped first portion 27 comprising about one-third of the layer disposed between the lower edge 18, the inside edge 26, and a bottom portion 31 of the inner edge 24, and a second portion 29 comprising about two-thirds of the layer 12 conjoined to the first portion 27 and disposed between the lower edge 18, the outer edge 20, the upper edge 22 and a top portion 33 of the inner edge 24, the bottom portion 31 and top portion 33 of the inner edge 24 curving inwardly from an inside corner 35 of the upper edge 22 toward a top corner 37 of the inside edge 26.

In addition, an adhesive backing 40 covers the entire rear side 16 of each layer 12. A peel-off pulltab 45 is removably disposed over the adhesive backing 40 between the lower edge 18, the inside edge 26, and an amount of the inner edge 24 bottom portion 31 of each layer 12. A coated first backing 50 removably covers each pulltab 45. A coated second backing 55 removably covers the adhesive backing 40 disposed on the rear side 16 of an outermost 60 of the layers 12.

Utilizing a buttocks uplift and support device 10, a wearer 80 removes the coated second backing 55 disposed on the rear side 16 of the outermost 60 of the layers 12. Then, the wearer removably adheres the inside edge 24 of the outermost 60 of the layers 12 in a wearing position to each of a wearer's 80 buttocks 85. To place at least one layer 12 in the wearing position, a wearer adheres the inside edge 26 to a wearer's inner thigh 86 directly below one of the wearer's buttocks 85, the upper edge 22 to the buttock 85, the outer edge 20 to the wearer's outer thigh 88, the lower edge 18 across and behind an upper portion 90 of wearer's leg 92. When the device 10 is in proper position the device 10 uplifts, supports, and separates the wearer's buttocks.

A wearer 80 may select the number of layers 12 desired for wearing in the wearing position by selectively removing at least one of the layers 12 by pulling one of the pulltabs 45 across the first portion 27 and second portion 29 and removing the pulltab 45 for each layer 12 remaining in the wearing position.

Each layer 12 preferably has a width of about 11 inches, a maximum height of about 7¾ inches measured from the lower edge 18 to the upper edge 22, and a minimum height of about 2½ inches measured from the lower edge 18 to the bottom portion 31 of the inner edge 24. Each layer 12 is preferably formed of hypoallergenic material 13. The adhesive backing 40 is preferably formed of non-toxic material 42.

With respect to the above description then, it is to be realized that the optimum dimensional relationships for the parts of the present buttocks uplift and support device to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of using a buttocks uplift and support device to uplift and separate a wearer's buttocks, the method comprising:

utilizing a buttocks uplift and support device comprising:

at least two flexible layers, each layer stacked atop another layer and having a front side, a rear side, a lower edge, an outer edge, an upper edge parallel to the lower edge, a substantially convex inner edge, an inside edge, a substantially parallelepiped first portion comprising about one-third of the layer disposed between the lower edge, the inside edge, and a bottom portion of the inner edge, and a second portion comprising about two-thirds of the layer conjoined to the first portion and disposed between the lower edge, the outer edge, the upper edge and a top portion of the inner edge, the top portion and bottom portion of the inner edge curving inwardly curving inwardly from an inside corner of the upper edge toward a top corner of the inside edge;

an adhesive backing covering the entire rear side of each layer;

a peel-off pulltab removably disposed over the adhesive backing between the lower edge, the inside edge, and an amount of the bottom portion of the inner edge of each layer;

a coated first backing removably covering each pulltab;

a coated second backing removably covering the adhesive material disposed on the rear side of an outermost of the layers;

removing the coated second backing disposed on the rear side of the outermost of the layers;

removably adhering the inside edge of the outermost of the layers in a wearing position to each of a wearer's buttocks, the wearing position comprising adhering the inside edge to a wearer's inner thigh directly below a buttock, the upper edge to the buttock, the outer edge to a wearer's outer thigh, the lower edge across and behind an upper portion of a wearer's leg;

wherein wearing at least one of the layers in the wearing position uplifts and separates the wearer's buttocks.

2. The method of claim 1 further comprising:

selectively removing at least one of the layers by pulling one of the pulltabs across the first portion and second portion; and removing the pulltab for each layer remaining in the wearing position.

3. A method of using a buttocks uplift and support device to uplift and separate a wearer's buttocks, the method comprising:

utilizing a buttocks uplift and support device comprising:

at least two flexible layers, each layer stacked atop another layer and having a front side, a rear side, a lower edge, an outer edge, an upper edge parallel to the lower edge, a substantially convex inner edge, an inside edge, a substantially parallelepiped first portion comprising about one-third of the layer disposed between the lower edge, the inside edge, and a bottom portion of the inner edge, and a second portion comprising about two-thirds of the layer conjoined to the first portion and disposed between the lower edge, the outer edge, the upper edge and a top portion of the inner edge, the top portion and bottom portion of the inner edge curving inwardly toward a top corner of the lower edge;

wherein each layer has a width of about 11 inches, a maximum height of about 7¾ inches measured from the lower edge to the upper edge, and a minimum height of about 2½ inches measured from the lower edge to the bottom portion of the inner edge;

an adhesive backing covering the entire rear side of each layer;

a peel-off pulltab removably disposed over the adhesive backing between the lower edge, the inside edge, and an amount of the bottom portion of the inner edge of each layer;

a coated first backing removably covering each pulltab;

a coated second backing removably covering the adhesive material disposed on the rear side of an outermost of the layers;

wherein each layer is formed of hypoallergenic material;

wherein the adhesive backing is formed of non-toxic material;

removing the coated second backing disposed on the rear side of the outermost of the layers;

removably adhering the inside edge of the outermost of the layers in a wearing position to each of a wearer's buttocks, the wearing position comprising adhering the inside edge to a wearer's inner thigh directly below a buttock, the upper edge to the buttock, the outer edge to a wearer's outer thigh, the lower edge across and behind an upper portion of wearer's leg;

wherein wearing at least one of the layers in the wearing position uplifts and separates the wearer's buttocks.

4. The method of claim 3 further comprising:

selectively removing at least one of the layers by pulling one of the pulltabs across the first portion and second portion; and removing the pulltab for each layer remaining in the wearing position.

* * * * *